United States Patent [19]

Frame et al.

[11] 4,367,685

[45] Jan. 11, 1983

[54] PROCESS AND APPARATUS FOR PRECISELY METERING QUANTITIES OF GRANULAR OR PULVERULENT SOLIDS

[76] Inventors: Scott W. Frame, 413 Knox Ave., Anniston, Ala. 36201; David P. Frame, 217 S. Ellis St., Salisbury, N.C. 28144

[21] Appl. No.: 185,388

[22] Filed: Sep. 8, 1980

[51] Int. Cl.[3] ..... F23D 1/00; B65G 53/50; F23K 3/02

[52] U.S. Cl. ..... 110/347; 110/263; 406/34; 406/93; 406/144

[58] Field of Search ..... 406/12, 14, 19, 29, 406/30, 31, 34, 93, 94, 115, 142, 143, 144, 146; 110/104 R, 105, 106, 263, 265, 347

[56] References Cited

U.S. PATENT DOCUMENTS

| | | | |
|---|---|---|---|
| 528,419 | 10/1894 | Duckham | 406/142 |
| 749,206 | 1/1904 | Limbert | 406/93 |
| 1,942,379 | 1/1934 | Thompson | 406/144 X |
| 3,179,378 | 4/1965 | Zenz et al. | 406/142 X |
| 4,002,372 | 1/1977 | Edwards et al. | 406/94 |
| 4,092,094 | 5/1978 | Lingl, Jr. | 110/106 X |
| 4,131,072 | 12/1978 | Lingl, Jr. et al. | 406/123 X |

FOREIGN PATENT DOCUMENTS

| | | | |
|---|---|---|---|
| 647650 | 10/1962 | Italy | 406/144 |

*Primary Examiner*—Jeffrey V. Nase

*Attorney, Agent, or Firm*—Wenderoth, Lind & Ponack

[57] ABSTRACT

A supply container contains therein a supply of granular or pulverulent solid fuel material. A air supply conduit extends into the supply container and has an outlet end at a position within the supply container to be embedded within the solid fuel material. The fuel outlet conduit extends into the supply container and has an inlet end at a position within the supply container to be embedded within the solid fuel material. The outlet end of the air supply conduit and the inlet end of the fuel outlet conduit confront each other and are separated from each other by a space. A feed flow of air is supplied through the air supply conduit outwardly through the outlet end thereof, to entrain and blow particles of the solid fuel material positioned in the space into the fuel outlet conduit. The feed flow of air and particles entrained thereby are then discharged into a transport conduit and conveyed to a burner.

17 Claims, 2 Drawing Figures

PROCESS AND APPARATUS FOR PRECISELY METERING QUANTITIES OF GRANULAR OR PULVERULENT SOLIDS

BACKGROUND OF THE INVENTION

The present invention is directed to a process and apparatus for precisely metering quantities of granular or pulverulent solids to positions or locations of utilization of such solids.

The present invention is more particularly directed to such a process and apparatus for precisely metering quantities of granular or pulverulent solid fuel to a burner.

Thus, while in its broadest aspects the present invention is directed to a process and apparatus for precisely metering quantities of any type of granular or pulverulent solid material, such as sand or various powdered or granulated chemicals, the present invention is particularly directed to such a process and apparatus for precisely metering small quantities of granular or pulverulent solid fuels, such as coal, lignite, or wood wastes, to burners of tunnel kilns, heat treating furnaces, blast furnaces, fluid bed combustors, and other known combustion devices where a number of relatively small, independently controlled burners are required.

Although various systems exist for controlling the feed of large quantities of pulverized solid fuel to large burners such as boilers, only a relatively few types of systems are available for metering such fuels to a number of small burners. Such known systems for metering granular or pulverulent solid fuel to a number of small burners may be generally classified as either mechanical or pneumatic devices.

Such known devices of the mechanical type require moving parts in contact with the granular or pulverulent solid material and are thus subject to wear, jamming, breakdown and high maintenance and operating costs. Control of the fuel feed is non-linear and is not readily calibrated, such that repeatability of precise fuel feed control is difficult. The capital cost of such mechanical devices is high.

Among the known types of pneumatic devices are air gravity conveyor systems. However, this type of system does not allow for independent control of individual burners. Thus, by the very nature of operation of this type of device, a change in the feed rate to one burner will noticeably change the feed rate to all down stream burners. Furthermore, the feed of the granular or pulverulent fuel is subject to waving and pulsing as a function of time, is not easily repeatable, and therefore cannot accurately be calibrated.

Further known systems of the pneumatic type are evidenced by U.S. Pat. No. 1,305,726 to Leonard et al., U.S. Pat. No. 4,002,372 to Edwards et al., and U.S. Pat. No. 4,085,976 to Edwards et al. These systems achieve feed of a granular fuel by creating suction in a feed line. In this type of known system, however, a change in the supply of combustion air line will directly effect the amount of fuel supplied. Furthermore, the system according to the two Edwards et al. patents provides for a small air stream to blow across an angle of repose of a pile of granular coal and pick-up particles of coal from the side or angle of repose. Thus, the supply of fuel is dependent upon the pile of fuel having a constant angle of repose. However, since the angle of repose of the pile of fuel particles in fact inevitably changes during the passage of time, the feed of fuel from this type of system pulses or waves as the bed is depleted an then replenished. This pulsing or waving produces a significant effect on the operation of the burner, since the overall fuel flow to the burner is relatively small. Due to this pulsing, it is not possible to achieve precise on-ratio combustion or below ratio turn down of the parameters.

Further known systems of the pneumatic type are evidenced by U.S. Pat. No. 4,092,094 to Lingl and U.S. Pat. No. 4,131,072 to Lingl. These known systems provide for a flow of combustion air passing through an angle of repose of a pile of granular fuel. Thus, these systems suffer from the inherent disadvantages of pulsing and waving due to changes in the angle of repose in the pile of coal. Also, since in these systems it is the combustion air itself which feeds the granular or pulverulent fuel, any change in the supply of combustion air has a obvious direct effect on the supply of fuel.

Those systems supplying fuel from or through an angle of repose of a pile of fuel are particularly subject to variations in flow rate of the fuel supplied, since the angle of repose will inherently be a function of the density, particle size, particle shape, and moisture content of the particular fuel particles, and even a small change in any of these parameters will substantially effect the angle of repose and thus the flow rate of the fuel supplied.

SUMMARY OF THE INVENTION

With the above discussion in mind, it is a primary object of the present invention to provide a process and apparatus for precisely metering quantities of granular or pelverulent solids while overcoming the prior art disadvantages.

It is a more specific object of the present invention to provide such a process and apparatus for precisely metering quantities of granular or pulverulent fuel to a burner, and particularly to one burner of a plurality of relatively small, independently controlled burners of the type used in tunnel kilns, heat treating furnaces, blast furnaces, fluid bed combustors, or other similar combustion devices.

A further object of the present invention is to provide such a process and apparatus whereby it is possible to achieve a precise control of the feed rate of the fuel within a relatively small range and to achieve an adjustment of the feed rate of the fuel over a large range.

It is an even further object of the present invention to provide such a process and apparatus whereby it is possible to obtain a precisely controlled rate of fuel feed which is not pulsed or waved.

It is a yet further object of the present invention to provide such a process and apparatus whereby control of the fuel feed is almost totally independent of the control of combustion air to the burner.

It is a still further object of the present invention to provide such a process and apparatus whereby control of the fuel feed rate is substantially linear.

It is a still even further object of the present invention to provide such a process and apparatus whereby fuel feed rates are easily repeatable, and whereby construction is simple, quick and inexpensive employing standard, off-the-shelf pipes and fittings.

The above objects are achieved in accordance with the present invention by the provision of a process and apparatus for precisely metering quantities of granular or pulverulent solids and conveying such solids to positions or locations of utilization. A supply container contains therein a supply of granular or pulverulent solid material. A gas supply conduit extends into the supply container, the gas supply conduit having an outlet end at a position within the supply container to be embedded within the solid material, and the gas supply conduit having an inlet end. A solids outlet conduit extends into the supply container, the solids outlet conduit having an inlet end at a position within the supply container to be embedded within the solid material, and the solids outlet conduit having an outlet end positioned outwardly of the supply container. The outlet end of the gas supply conduit and the inlet end of the solids outlet conduit confront each other and are spaced from each other by a space at locations within the supply container. A gas supply source is connected to the inlet end of the gas supply conduit and supplies a feed flow of gas through the gas supply conduit and outwardly through the outlet end thereof. This feed flow entrains and blows particles of the solid material positioned in the space into the inlet end of the solids outlet conduit. The feed flow and particles entrained thereby are discharged from the outlet end of the solids outlet conduit.

In accordance with a more specifically preferred embodiment of the present invention, the process and apparatus precisely meter quantities of granular or pulverulent solid fuel to a burner. In this embodiment of the invention, the granular solid material comprises granular or pulverulent solid fuel material, air is supplied through the supply conduit, and a transport conduit is connected to the outlet end of the outlet conduit and transports the feed flow and entrained particles to a burner.

By the above features of the present invention, the flow rate of granular or pulverulent solid material, and specifically fuel particles, is smooth and even, without pulsing or waving. Advantages of such smooth, even fuel flow are a much more uniform heat distribution, a much more precise and constant control of temperature settings, and the ability of precisely adjusting combustion air for on-ratio, oxidizing or reducing conditions.

The flow rate of the feed flow of air fed to the air supply conduit can be regulated to precisely control the feed rate of fuel within a relatively small range. Thus, if more heat is required at a burner, it is possible to simply increase the feed flow of air, thereby entraining slightly more coal. Conversely, if less heat is required at a burner, this may be achieved by merely reducing the feed flow of air and thereby entraining a smaller quantity of fuel. After such adjustments, the flow of solid fuel particles will be smooth and continuous. Automatic zone control of a bank of burners, or of individual burners, may be easily achieved by regulating the feed flow of air by means of known devices, for example a standard pressure regulator and temperature controller. A flow meter may be provided to achieve an indication of the flow rate. Such flow meter may be calibrated to indicate the flow rate of the feed flow of air, or alternatively the flow meter may be calibrated to indicate the flow rate of particles entrained by the feed flow as a function of the flow rate of the feed flow.

The rate of feed of fuel particles can be controlled over a wide range of control by regulating or changing the size of the space between the outlet end of the air supply conduit and the inlet end of the fuel outlet conduit. Specifically, at least one of the air supply conduit and the fuel outlet conduit may be moved in opposite directions axially thereof. More specifically, this may be achieved by threading the air supply conduit and the fuel outlet conduit through opposite walls of the supply container, and by selectively rotating at least one of the thus threaded air supply conduit and fuel outlet conduit to result in axial movement thereof.

Combustion air for the burner is supplied through the transport conduit and achieves conveying of the feed flow and entrained particles to the burner. The supply of combustion air may be regulated completely independently of the supply of the feed flow. The feed flow comprises less than two percent of the quantity of air required for stoichometric combustion of the particles of the solid fuel material at the burner. Thus, it is possible to achieve an excellent on-ratio burner turn down. Further, by this arrangement it is also possible to completely or substantially completely turn off the supply of combustion air, thereby providing extreme reducing conditions. Thus, it is possible to fire bricks in a kiln under extreme reducing conditions to achieve various desired colors. Also, in a tunnel kiln, the burners can be fired below ratio to achieve enormous fuel savings by then using high temperature preheated combustion air drafted down the tunnel from the cooling zone to complete combustion of the fuel.

BRIEF DESCRIPTION OF THE DRAWINGS

Other objects, features and advantages of the present invention will be apparent with the following detailed description, taken with the accompanying drawings, wherein.

DETAILED DESCRIPTION OF THE INVENTION

With reference now to the drawings, there will be described a preferred embodiment of the present invention, specifically directed to the metering and supplying to a burner of granular or pulverulent solid fuel. It is to be understood, however that the scope of the present invention is not intended to be limited to the specific metering of granular or pulverulent solid fuel to a burner. Rather, the process and apparatus of the present invention are directed to the precise metering to positions or locations of utilization of quantities of any type of granular or pulverulent solid material, for example sand or various types of powdered or granular chemicals or grains.

Figure 1:
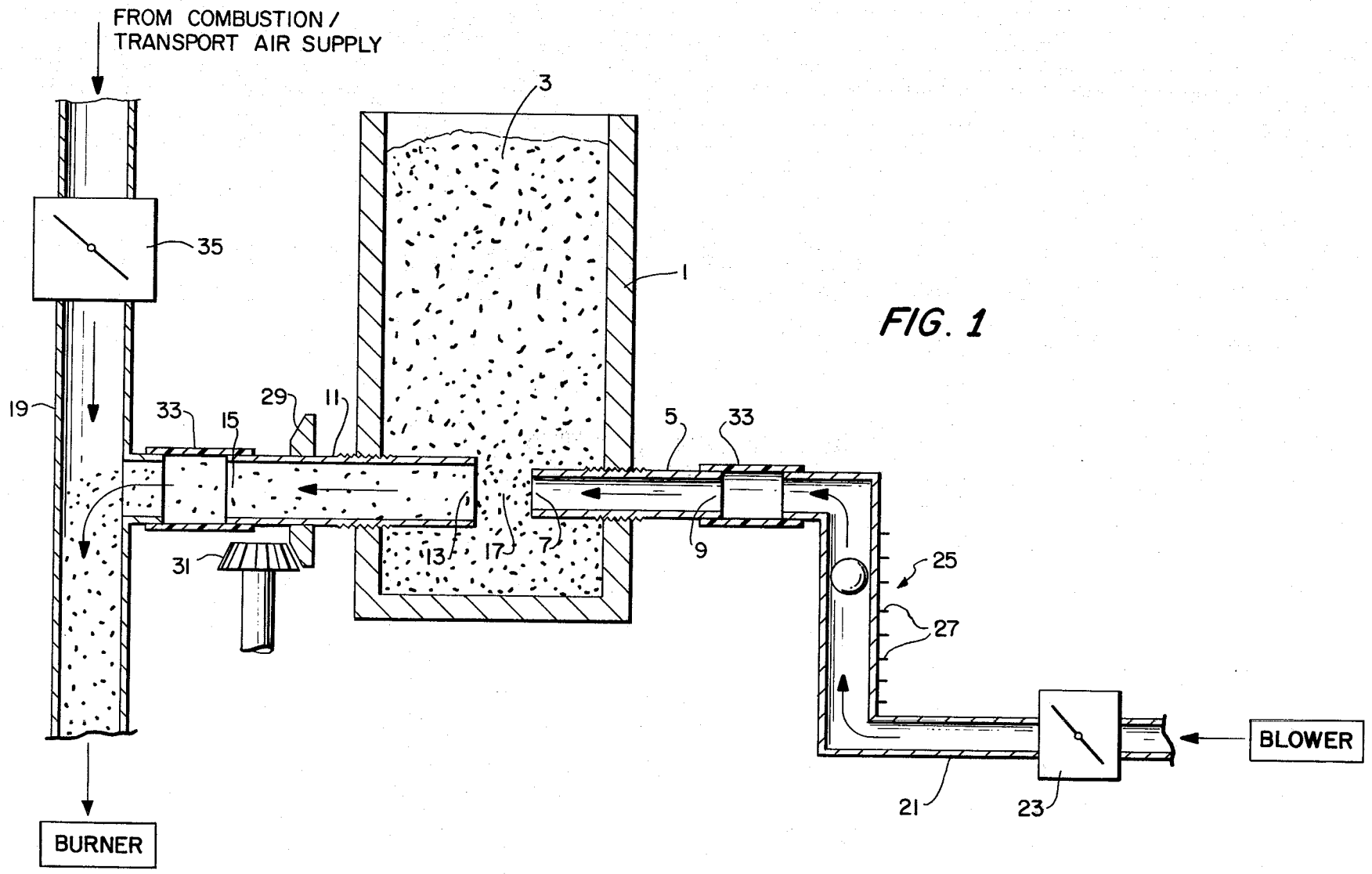
FIG. 1 is a schematic cross-sectional view illustrating one embodiment of the present invention.

In FIG. 1 there is schematically shown a preferred embodiment of the present invention for precisely metering quantities of granular or pulverulent solid fuel to a burner. Specifically, a supply container 1 contains therein a supply of granular or pulverulent solid fuel material 3. Supply container 1 may take any otherwise known conventional form, such as a hopper, bin, etc. The supply of fuel material 3 may be supplied and/or replenished to supply container 1 in any conventional manner.

An air supply conduit 5 extends into supply container 1 and has an outlet end 7 at a position within the supply container 1 to be embedded within the solid fuel material 3. Air supply conduit 5 has an inlet end 9. A fuel outlet conduit 11 extends into supply container 1 and has an inlet end 13 at a position within supply container 1 to be embedded within the solid fuel material 3. Fuel outlet conduit 11 has an outlet end 15 positioned outwardly of supply container 1. The outlet end 7 of the air supply conduit 5 and the inlet end 13 of the fuel outlet conduit 11 confront each other, as shown in FIG. 1, and are separated from each other by a space or gap 17 within the supply container 1.

In accordance with the fundamental novel concept of the present invention, a feed flow of air is supplied through the air supply conduit 5, as shown by the arrows in FIG. 1, and flows outwardly through the outlet end 7. This feed flow entrains and blows those fuel particles positioned in the space 17. Thus, as the feed flow of air continues through the fuel outlet conduit 11, it entrains and carries along therewith particles of the fuel.

A transport conduit 19 is connected to the outlet end 15 of the fuel outlet conduit 11 and is connected to a burner (not shown). Thus, the feed flow of air and the fuel particles entrained thereby discharge into the transport conduit 19 and are conveyed thereby to the burner, as shown by the arrows in FIG. 1.

The feed flow of air may be supplied from a blower through a pipe 21 to the air supply conduit 5. A flow control valve 23 may be provided within pipe 21 for regulating the flow rate of the feed flow of air fed to the air supply conduit 5. By operation of control valve 23 it is possible to achieve a precise control of the flow rate of the feed flow of air, and thereby a precise control, within a limited range, of the quantity of fuel entrained by the feed flow. Thus, with all other parameters remaining equal, if more heat is required at the burner, it is simply necessary to slightly open flow control valve 23 to provide a greater feed flow of air. This will result in a greater quantity of fuel from space 17 being entrained by the feed flow of air, and thus a greater quantity of fuel will be supplied to the burner. Conversely, if less heat is required at the burner, the flow control valve 23 may be slightly closed. Additionally, the pipe 21 may have therein a flow meter, indicated generally and schematically at 25. Flow meter 25 may be calibrated, as indicated schematically by indicia 27, to indicate the flow rate of the feed flow of air, or to indicate the flow rate of particles entrained by the feed flow of air as a function of the flow rate of the feed flow of air.

Figure 2:
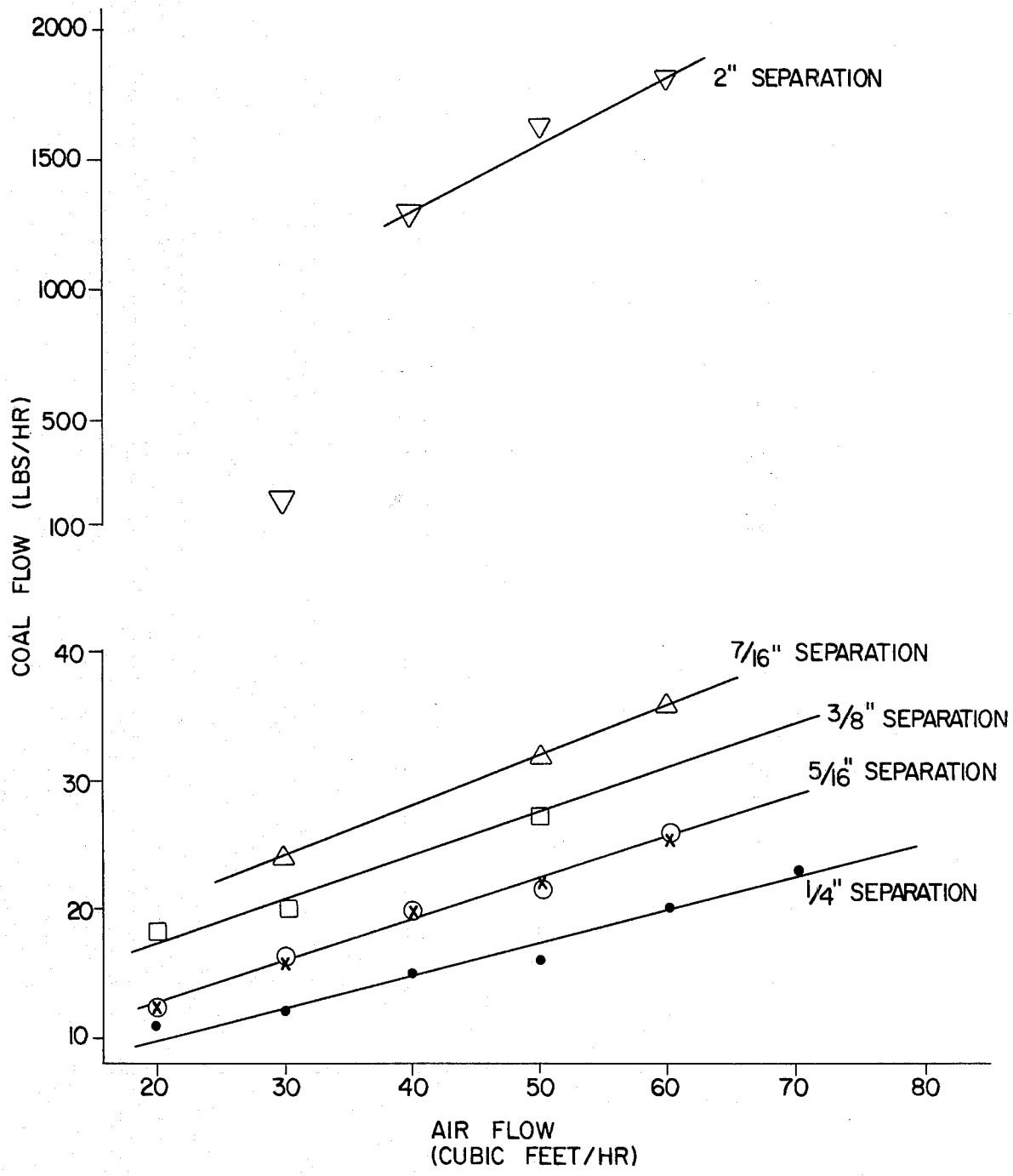
FIG. 2 is a graph illustrating the wide range of fuel flow rates possible in accordance with the present invention.

The quantity of fuel entrained by the feed flow of air and supplied to the burner may be regulated and adjusted within a wide range of control in accordance with another novel feature of the present invention. More specifically, it has been discovered in accordance with the present invention that by changing the size of space or gap 17, all other parameters remaining the same, it is possible to substantially alter the quantity of fuel particles entrained by the feed flow of air. Thus, by moving outlet end 7 of air supply conduit 5 and inlet end 13 of fuel outlet conduit 11 away from and toward each other, it is possible to substantially increase and decrease, respectively, the relative quantities of fuel entrained by the feed flow of air. Thus, as shown in the graph of FIG. 2, when the size of space or gap 17 is ¼", the solid fuel flow rates can be precisely controlled between approximately 10 and approximately 20 pounds per hour. As the size or distance of space 17 is increased, the solid fuel flow rates are also increased. At a distance or size of space 17 of 2", it is possible to accurately control the solid fuel flow rate up to approximately 2000 pounds per hour. Thus, by setting the size or distance of space 17, it is possible to achieve an approximate solid fuel flow rate setting, within a relatively narrow range. The solid fuel flow rate is then precisely set by adjusting flow control valve 23. The data incorporating the graph of FIG. 2 was achieved with the opening in outlet end 7 of air supply conduit 5 being ⅛", and with the opening in inlet end 13 of fuel outlet conduit 11 being ⅜". It is possible to alter the sizes of the openings at outlet end 7 and at inlet end 13 by means of exchangeable orifice nozzles (not shown), such expedient being particularly useful at outlet end 7, which preferrably is smaller than inlet end 13.

It is intended that the present invention encompass any structural arrangement for achieving movement of either or both of conduits 5 and 11 in opposite directions axially thereof, to thereby change the size or distance of space or gap 17. In the illustrated embodiment of FIG. 1, conduits 5 and 11 have exterior threads which are threaded into interiorly threaded openings in opposite walls of supply container 1. Further, axial movement is achieved by means of rotating the conduits in their threaded mountings. In the illustrated arrangement of FIG. 1, such a rotation is achieved by a bevel gear 29 being fixed exteriorly of conduit 11, gear 29 meshing with another bevel gear 31 fixed to a rotating shaft. In the illustrated arrangement, this rotation structure is shown as being applied only to conduit 11. It is to be understood however that a similar structure could be applied to conduit 5. Furthermore, any other known mechanical expedients may be employed to rotate conduits 5 and/or 11 within their threaded mountings, thereby achieving axial movement of the conduits. Additionally, it is to be understood that it is within the scope of the present invention to provide other known mechanical arrangements to achieve axial movement of conduits 5 and 11. Further, it is to be understood that the pipes and conduits of the present invention are connected to each other as necessary to allow for such axial movement of conduits 5 and 11. In the illustrated arrangement of FIG. 1, conduits 5 and 11 are attached to flow meter 25 and transport conduit 19, respectively, by flexible conduits 33. However, this illustration is schematic only and is not intended to be limiting to the scope of the present invention.

A source of combustion air is connected to transport conduit 19, such that this combustion air passes through transport conduit 19 to the burner and provides the combustion air therefor. This combustion air also acts to transport the feed flow of air and fuel particles entrained thereby to the burner. Shut-off and regulating valve 35 is provided in transport conduit 19 to regulate and/or shut-off the supply of combustion air.

Due to the fact that the outlet end 7 of air supply conduit 5 and the inlet and 13 of fuel outlet conduit 11 are embedded within the fuel particles at a location in the center of the bottom of the supply of fuel particles within the supply container 1, blowing of the feed flow of air through the air supply conduit 5 and into the confronting fuel outlet conduit 11 will cause entrainment of fuel particles located in space 17. As entrained particles are removed from space 17, there will be a constant and continuous replenishment of such particles into space 17. This replenishment is always consistent since the space 17 is in the center of the supply. Thus, entrainment and supply of fuel particles in accordance with the present invention is not dependent upon an angle of repose of the pile of fuel particles, and is thus not subject to variations in density, particle size, particle shape and moisture content of the particles. Accordingly, close attention to the preceding solid fuel processing and preparation operations, which was necessary to achieve uniformity of supply of fuel particles in prior art systems, is unnecessary in accordance with the present invention.

The flow rate and supply of fuel particles to the burner will be smooth, continuous and constant at given settings of the apparatus, thereby avoiding the pulsing or waving which inevitably occurs in prior art systems.

The present invention has two separate fuel flow rate controls. Thus, by adjusting the size or distance of space 17, it is possible to vary the range of the flow rate of the fuel from 0 to approximately 70 pounds per hour on up to from zero to approximately 2000 pounds per hour, all by employing the same structure. Precise fuel flow rate control within a given setting of the distance or size of space 17 may be achieved by regulation of flow control valve 23. This capability eliminates costly engineering and other associated design and installation costs by eliminating the need for a plurality of separate parts for different fuel flow rates. Additionally, with this wide range of fuel flow rate control, control of burner turndown is exceptional. This is significant in batch or periodic operations where very low fuel rates must be used initially to provide controlled warm-up, and then a very high fuel rate is called for during a high temperature heat treatment. It is to be understood that provision could be made for remote or automatic operation of the axial movement of conduits 5 and 11 to vary the distance or size of space 17.

A further advantageous feature of the present invention is that the control of the fuel flow is substantially totally independent of the control of the combustion air. Thus, the control of the combustion air via shut-off valve 35 is totally independent of the control of the fuel via flow control valve 23. This is different from prior art systems, wherein a change in the quantity of combustion air supplied will inherently effect the fuel flow rate.

It is to be understood that it is intended that each burner of a plurality of relatively small, independently controlled burners are supplied with fuel and combustion air from a separate respective system of the present invention, such as shown in FIG. 1. However, it is to be further understood that it is to be possible to provide a single manifold supplying feed flow air to all of the pipes of a plurality of the systems shown in FIG. 1.

In accordance with the present invention the quantity of the feed flow of air employed to entrain the fuel particles is less than 2%, and preferably approximately 1%, of the quantity of air required for stoichometric combustion of the particles of solid fuel material at the burner. Thus, variations in the quantity of feed flow of air to achieve a desired precise fuel flow rate do not in any way substantially effect a given combustion air flow rate. Further, due to the independent control of the combustion air from the feed flow air, it is possible to achieve excellent on-ratio burner turndown, i.e. better than 98%. This is a very significant advantage of the present invention, since enormous net fuel savings can be realized in a tunnel kiln by firing the burner below ratio and using high temperature preheated combustion air drawn down the tunnel from the cooling zone to complete combustion of the fuel. Additionally, in accordance with the present invention it is possible to substantially completely shut-off the supply of combustion air without effecting the fuel supply to the burner. Thereby it is possible to operate the burner under extreme reducing conditions. This makes it possibe to fire bricks under reducing conditions to achieve desired color effects.

In accordance with the present invention the control of the fuel flow rate is substantially linear and is smooth and continuous, without pulsing or waving.

Additionally, in accordance with the present invention, the fuel particles do not come in contact with moving parts, thereby leading to a longer useful life of the apparatus of the present invention.

Complete shut-off of the combustion air flow is possible without effecting the flow of fuel, and conversely, complete shut-off or regulation of the fuel flow rate is possible without effecting the combustion air flow. This flexibility is not possible in prior art systems.

It is possible in accordance with the present invention to easily calibrate the fuel flow rate, with the settings being easily repeatable, and control of such settings may be easily and inexpensively automated.

Although the present invention has been described and illustrated with respect to preferred features thereof, it is to be understood that various modifications may be made without departing from the scope of the present invention.

We claim:

1. An apparatus for precisely metering quantities of granular or pulverulent solid fuel to a burner to achieve stoichometric combustion of the fuel at the burner, said apparatus comprising:

a supply container means for containing therein a supply of granular or pulverulent solid fuel material;

an air supply conduit extending into said supply container means, said air supply conduit having an outlet end at a position within said supply container means to be embedded within said solid fuel material, and said air supply conduit having an inlet end;

a fuel outlet conduit extending into said supply container means, said fuel outlet conduit having an inlet end at a position within said supply container means to be embedded within said solid fuel material, and said fuel outlet conduit having an outlet end positioned outwardly of said supply container means;

said outlet end of said air supply conduit and said inlet end of said fuel outlet conduit being separated from each other by a space and confronting each other at locations within said supply container means;

transport conduit means, connected to said outlet end of said fuel outlet conduit and having means for connecting said transport conduit means to a burner, for transporting to the burner a feed flow and entrained particles;

said fuel outlet conduit extending substantially horizontally from said inlet end thereof at said space to said outlet end thereof connected to said transport conduit means;

air supply means, connected to said inlet end of said air supply conduit, for supplying a feed flow of air through said air supply conduit and outwardly through said outlet end thereof, for entraining and blowing particles of said solid fuel material positioned in said space into said inlet end of said fuel outlet conduit, and for discharging said feed flow and entrained particles from said outlet end of said fuel outlet conduit into said transport conduit means;

combustion air supply means, connected to said transport conduit means, for supplying to the burner through said transport conduit means combustion air, and thereby for conveying said feed flow and entrained particles through said transport conduit means to the burner; and said air supply means comprising means for supplying less than 2% of the quantity of air required for stoichometric combustion of said particles of solid fuel material at the burner, and said combustion air supply means comprising means for supplying the remainder of air required for such stoichometric combustion.

2. An apparatus as claimed in claim 1, wherein said air supply means includes a blower, pipe means extending between said blower and said inlet end of said air supply conduit, and flow control valve means in said pipe means for regulating the flow rate of said feed flow of air fed to said air supply conduit and for thereby regulating the quantity of said particles entrained by said feed flow.

3. An apparatus as claimed in claim 2, further comprising flow meter means in said pipe means between said flow control valve means and said air supply conduit.

4. An apparatus as claimed in claim 3, wherein said flow meter means is calibrated to indicate said flow rate of said feed flow of air fed to said air supply conduit.

5. An apparatus as claimed in claim 3, wherein said flow meter means is calibrated to indicate the flow rate of said particles entrained by said feed flow of air fed to said air supply conduit.

6. An apparatus as claimed in claim 1, wherein said air supply conduit and said fuel outlet conduit comprise first and second pipes, respectively, extending through opposite walls of said supply container means, and further comprising means for moving at least one of said pipes in opposite directions axially thereof, and for thereby regulating the size said space and the quantity of said particles entrained by said feed flow.

7. An apparatus as claimed in claim 6, wherein at least one of said first and second pipes has exterior threads threaded into a respective interiorly threaded opening in said respective wall, and said moving means comprises means for rotating said at least one pipe.

8. An apparatus as claimed in claim 1, wherein said outlet end of said air supply conduit is of a smaller size than said inlet end of said fuel outlet conduit.

9. An apparatus as claimed in claim 1, further comprising shut-off valve mans in said transport conduit means for regulating the supply thereto and to the burner of said combustion gas.

10. A process for precisely metering quantities of granular or pulverulent solid fuel to a burner to achieve stoichometric combustion of the fuel at the burner, said process comprising:

providing a supply container containing therein a supply of granular or pulverulent solid fuel material;

providing an air supply conduit to extend into said supply container with an outlet end of said air supply conduit being embedded within said solid fuel material, said air supply conduit having an inlet end, and providing a fuel outlet conduit to extend into said supply container with an inlet end of said fuel outlet conduit being embedded within said solid fuel material at a location confronting said outlet end of said air supply conduit and separated therefrom by a space, said fuel outlet conduit having an outlet end exterior of said supply container;

providing a transport conduit connected to said outlet end of said fuel outlet conduit and to said burner, with said fuel outlet conduit extending substantially horizontally from said inlet end thereof at said space to said outlet end thereof connected to said transport conduit;

supplying a feed flow of air through said air supply conduit and outwardly through said outlet end thereof, entraining and blowing particles of said solid fuel material positioned in said space into said fuel outlet conduit, and discharging said feed flow and entrained fuel particles from said outlet end of said fuel outlet conduit into said transport conduit;

supplying a flow of combustion air through said transport conduit to said burner, and employing said flow of combustion air to convey said feed flow and said entrained fuel particles through said transport conduit to said burner; and maintaining the amount of said feed flow of air supplied through said air supply conduit less than 2% of the quantity of air required for stoichometric combustion of said particles of solid fuel material at said burner, while providing the remainder of the air required for such stoichometric combustion from said combustion air supplied through said transport conduit.

11. A process as claimed in claim 10, further comprising regulating the flow rate of said feed flow of air fed to said air supply conduit, and thereby regulating the quantity of said fuel particles entrained by said feed flow.

12. A process as claimed in claim 11, further comprising metering said flow rate of said feed flow of said air fed to said air supply conduit.

13. A process as claimed in claim 11, further comprising metering the flow rate of said fuel particles entrained by said feed flow of air fed to said air supply conduit as a function of said flow rate of said feed flow.

14. A process as claimed in claim 10, further comprising regulating the quantity of said fuel particles entrained by said feed flow by changing the size of said space.

15. A process as claimed in claim 14, wherein said changing comprises moving at least one of said air supply conduit and said fuel outlet conduit in opposite directions axially thereof.

16. A process as claimed in claim 10, further comprising regulating the supply of said combustion air through said transport conduit.

17. A process as claimed in claim 16, further comprising substantially shutting-off the supply of said combustion air, while conveying said feed flow and entrained fuel particles to said burner, and thereby operating said burner under reducing conditions.

* * * * *